US009646468B2

(12) United States Patent
Smith et al.

(10) Patent No.: US 9,646,468 B2
(45) Date of Patent: May 9, 2017

(54) SAMPLE-PROCESSING SYSTEM WITH STATUS LIGHTS

(71) Applicant: Molecular Devices, LLC, Sunnyvale, CA (US)

(72) Inventors: Thomas L. Smith, Campbell, CA (US); Grischa Chandy, Fremont, CA (US); Timothy Arthur Floto, Scotts Valley, CA (US); Evan F. Cromwell, Redwood City, CA (US)

(73) Assignee: Molecular Devices, LLC, Sunnyvale, CA (US)

( * ) Notice: Subject to any disclaimer, the term of this patent is extended or adjusted under 35 U.S.C. 154(b) by 0 days.

(21) Appl. No.: 14/826,290

(22) Filed: Aug. 14, 2015

(65) Prior Publication Data

US 2017/0046928 A1 Feb. 16, 2017

(51) Int. Cl.
*G08B 21/00* (2006.01)
*G08B 5/36* (2006.01)

(52) U.S. Cl.
CPC ..... *G08B 5/36* (2013.01)

(58) Field of Classification Search
None
See application file for complete search history.

(56) References Cited

U.S. PATENT DOCUMENTS

2016/0186240 A1* 6/2016 Andreyev ..... C12Q 1/686
435/287.2

* cited by examiner

*Primary Examiner* — Adolf Dsouza
(74) *Attorney, Agent, or Firm* — Bella Fishman

(57) ABSTRACT

System, including methods and apparatus, for sample processing. In exemplary embodiments, the system comprises a plurality of devices to perform a protocol on sample holders supporting samples, and also comprises a control system that coordinates operation of the plurality of devices, such that the protocol is performed automatically. Each device of at least two of the plurality of devices may have one or more status lights configured to display a plurality of different visual indicators each indicating a different status of the device. The at least two devices may utilize a same indicator scheme as one another for each different status indicated by the visual indicators. In some embodiments, the indicator scheme is user-configurable. In some embodiments, the one or more status lights of at least one device are provided by one or more recessed light-emitting strips.

20 Claims, 9 Drawing Sheets

SAMPLE-PROCESSING SYSTEM WITH STATUS LIGHTS

INTRODUCTION

Laboratory procedures to perform sample manipulation, propagation, and analysis are becomingly increasingly automated. Scientific instruments can be functionally linked to one another via robotics to perform complex sample-processing procedures, such as drug screening, assay development and validation, colony isolation, and the like. In some cases, a master controller with scheduling software orchestrates operation of the instruments, to provide fully automated sample processing. However, the scheduling software can be difficult to configure properly for a particular set of instruments and processing steps. Accordingly, scheduling conflicts occur frequently and may not be readily distinguishable from an instrument failure. Better approaches are needed for visualizing the operation of instruments in sample-processing systems.

SUMMARY

The present disclosure provides a system, including methods and apparatus, for sample processing. In exemplary embodiments, the system comprises a plurality of devices to perform a protocol on sample holders supporting samples, and also comprises a control system that coordinates operation of the plurality of devices, such that the protocol is performed automatically. Each device of at least two of the plurality of devices may have one or more status lights configured to display a plurality of different visual indicators each indicating a different status of the device. The at least two devices may utilize a same indicator scheme as one another for each different status indicated by the visual indicators. In some embodiments, the indicator scheme is user-configurable. In some embodiments, the one or more status lights of at least one device are provided by one or more recessed light-emitting strips.

BRIEF DESCRIPTION OF THE DRAWINGS

FIG. 4 is an isometric view of an exemplary detection instrument for the system of FIG. 1, with the front, top, and right sides of the instrument visible, and with status lights of the instrument on.

FIG. 5 is another isometric view of the detection instrument of FIG. 4, with the back, top, and right sides of the instrument visible, and with status lights of the instrument on.

FIG. 6 is an elevation view of the detection instrument of FIG. 4 showing the front side of the instrument, with status lights of the instrument on.

FIG. 7 is an elevation view of the detection instrument of FIG. 4 showing the back side of the device, with status lights of the instrument on.

FIG. 8 is a plan view of the detection instrument of FIG. 4, with status lights of the instrument on.

FIG. 9 is an elevation view of the detection instrument of FIG. 4 showing the right side of the device, with status lights of the instrument on.

DETAILED DESCRIPTION

The present disclosure provides a system, including methods and apparatus, for sample processing. In exemplary embodiments, the system comprises a plurality of devices (also called instruments) to perform a protocol on sample holders supporting samples, and also comprises a control system that coordinates operation of the plurality of devices, such that the protocol is performed automatically. Each device of at least two of the plurality of devices may have one or more status lights configured to display a plurality of different visual indicators each indicating a different status of the device. The at least two devices may utilize a same indicator scheme as one another for each different status indicated by the visual indicators. In some embodiments, the indicator scheme is user-configurable. In some embodiments, the one or more status lights of at least one device are provided by one or more recessed light-emitting strips.

The status light system of the present disclosure may offer various advantages. Scheduling conflicts and instrument-specific problems may be identified more easily. Instrument performance may be visualized by a user at a distance and/or from substantially any angle above the instrument. The status light system provides harmonization of activity and error messaging schemes within a laboratory environment to improve recognition of specific messages.

Fully automated laboratory systems have scheduling software that may not be dynamic. Once a protocol is set up, it can be performed automatically. However, the software does not have the ability to revise the protocol to dynamically allocate resources. Scheduling conflicts are common because the instruments do not each perform their step(s) of the protocol at the same speed.

The status light system of the present disclosure allows a user to quickly determine if there is a conflict or error status, which allows proactive handling of problems. The progression of visual indicators by the status lights shows how sample processing is unfolding. When a problem is detected by observing the status lights, the user can put part of the system on hold, via the scheduling software, until a slow instrument catches up, or may intervene manually. To avoid further problems, the user can, for example, speed up slow instruments and/or slow down fast instruments.

Further aspects of the present disclosure are described in the following sections: (I) overview of sample-processing systems with status lights, (II) devices, (III) control system, (IV) status lights and lighting schemes, (V) sample holders and samples, and (VI) examples.

I. OVERVIEW OF SAMPLE-PROCESSING SYSTEMS WITH STATUS LIGHTS

Figure 1:
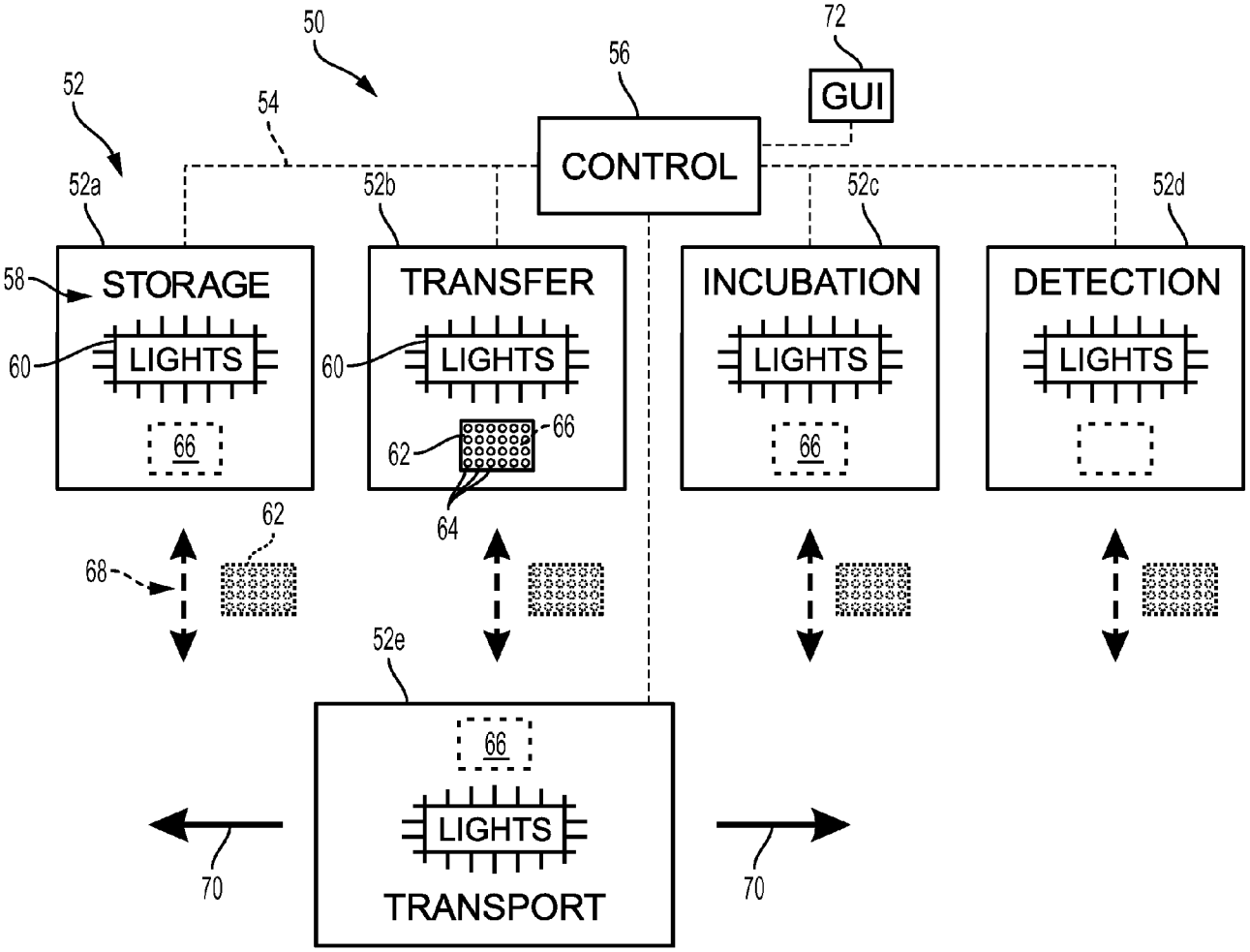
FIG. 1 is a schematic view of an exemplary sample-processing system configured to execute a protocol automatically and composed of a plurality of laboratory devices each having one or more status lights that indicate device status according to the same coding scheme, in accordance with aspects of the present disclosure.

This section provides an overview of exemplary sample-processing systems having a status light system to indicate the individual status of each device; see FIG. 1.

FIG. 1 shows an exemplary sample-processing system 50 configured to execute a sample-processing protocol. System 50 includes two or more devices 52, such as devices 52*a*-52*e*. (Each device 52 interchangeably may be termed an instrument, which may be called a scientific instrument or laboratory instrument.) Each device 52 may be in communication with, indicated at 54, a control system 56. The control system coordinates operation of devices 52, which allows the devices to perform the entire protocol automatically (i.e., without user intervention during execution of the protocol). Further aspects of exemplary devices for system 50, including devices 52*a*-52*e* of FIG. 1, are described below in Section II and Example 3. Further aspects of exemplary control systems are described below in Section III.

Sample-processing system 50 has a status light system 58 that indicates the current status of each device 52. (The status interchangeably may be called a state, and may indicate an activity and/or error state of the device.) More particularly, each device 52 has one or more status lights 60 to report device status according to a coding scheme shared by at least two, three, or all of the devices, among others. The status lights of each device may display the same visual indicator (e.g., created by the color, temporal modulation, and/or spatial modulation of light) for a given status. This display strategy may be especially beneficial if the user wants to implement a complex set of status indications in an automated environment with a large number of devices.

Status lights 60 of each device 52 are configured to emit visible radiation (i.e., visible light) having at least one characteristic that varies distinguishably according to the current state of the device, for at least two, three, or more different, predefined device states. The characteristic may be color, brightness, temporal variation, spatial variation, or a combination thereof, among others. The status lights allow visual identification of device status by a user. For example, the user may note the color, temporal variation (e.g., constant or flashing), and/or spatial variation (e.g., continuous or segmented) generated by the status lights of a device and then correlate that color and/or temporal/spatial variation with a particular device status based on the coding scheme (also called the indicator scheme) of the status light system. Further aspects of status lights and coding schemes are described below in Section IV and Example 1.

The sample-processing system performs a protocol on at least one sample holder 62 supporting one or more samples 64. In the depicted embodiment, sample holder 62 is a multi-well plate, but any suitable type(s) of sample holder may be utilized, as described further below in Section V.

Each device 52 may have at least one receiving area 66 to receive and support one or more sample holders. The receiving area may position and support a sample holder as the device is performing one or more steps of a protocol on the sample holder and/or one or more samples contained by the sample holder.

Devices 52 may include at least one transport device 52*e* configured to move sample holders 62 to and/or from each of the other devices, shown in phantom at 68. The transport device(s) has access to all of the other devices, and is configured to move the sample holder among the other devices, indicated by movement arrows at 70, in a sequence dictated by the protocol being performed.

Sample-processing system 50 may include a graphical user interface 72 connected to control system 56. The graphical user interface allows a user to configure aspects of status light system 58, such as selection of statuses, assignment of status colors, temporal and/or spatial modulation of light emission, and the like. Further aspects of an exemplary graphical user interface that may be suitable for system 50, and/or one or more devices thereof, are described below in Example 4.

Sample-processing system 50 may be configured to perform any suitable protocol. In some embodiments, system 50 may be used for propagation of cells, and may, for example, include an incubator, a robot arm, a high-content plate reader, and a colony picker. In some embodiments, system 50 may be used for analysis, and may, for example, include a fluid dispenser, a robot arm, an incubator, and a high-throughput plate reader.

II. DEVICES

This section describes exemplary devices for the sample-processing systems of the present disclosure; see FIG. 1.

The protocol executed by system 50 may consist of a series of steps each performed by one of devices 52. Exemplary steps of the protocol may include any combination of (1) moving a sample holder into or out of a storage location (e.g., to a pickup site or from a drop-off site), (2) transporting a sample holder between a pair of devices, (3) transferring material into or out of a sample holder, (4) exposing a sample holder and/or samples therein to a condition, and/or (5) detecting a signal from a sample contained by a sample holder, and/or (6) deciding what step to perform next, among others. (In some embodiments, the protocol may have a branch, and a visual indicator may be used to signal that a decision has been made regarding which step to perform next.) Each type of step may be performed one or more times in the protocol, by the same device or different devices. Accordingly, system 50 may have two or more different devices for storage, material transfer, exposure to a condition, detection, and/or transport among devices, among others. Exemplary devices 52*a*-52*e* of system 50 in FIG. 1 perform each of steps 1-5 above, as described further below. The devices form a sample-processing line among which sample holders and/or samples travel. The term "line" is not limited to a linear arrangement of devices or unidirectional travel of sample holders and/or samples to successive devices of the line.

At least one storage device 52*a* may keep sample holders 62 in an organized arrangement before and/or after the protocol is initiated with each successive sample holder. The storage device may position the sample holders in an array, and may keep track of the order in which sample holders are loaded into the array. The storage device may be configured to move each sample holder from the array to receiving area 66, for transport to other devices of the system. In some embodiments, the storage device may operate with a first in, first out (FIFO) logic, such that the sample holders are moved from the array to the receiving area, to begin the protocol, in the order in which they were loaded into the storage device (e.g., loaded manually or automatically). The same or a different storage device may move each sample holder from a receiving area 66 to an array, to complete the protocol for the sample holder and\or samples therein. In some embodiments, the storage device may lack any drive mechanism to actively move sample holders. Exemplary storage devices 52*a* include plate stackers, hotels, racks, or the like.

At least one transfer device 52*b* may transfer material into or out of one or more compartments of each sample holder during the protocol. The material may be fluid (e.g., liquid), solid, or a combination thereof, among others. The material may be added to a sample present in a compartment of a sample holder or may be removed from the compartment. Exemplary materials that may be transferred into a sample holder may include one or more assay reagents, analytes, test compounds, growth media, wash fluids, dilution fluids, or the like. Exemplary materials that may be transferred out of a sample holder may include at least a portion of a sample (e.g., cells or a colony), a wash fluid, one more assay reagents, a supernatant, or the like. The transfer device may transfer material between sample holders, to, for example, change the size or type of sample holder used for subsequent steps of the protocol. As an example, the transfer device may transfer a portion of a sample, such as cells and/or a colony, from a sample holder having one or more larger compartments to a different sample holder having a greater number of smaller compartments to hold samples. The transfer device may add material to a compartment of a sample holder by a contact or non-contact dispensing mechanism. Exemplary transfer devices 52*b* include automated pipet systems, colony pickers, aspirators, and the like.

At least one treatment device, such as an incubation device 52*c*, of system 50 may expose each sample holder and/or one or more samples therein to at least one controlled condition during execution of the protocol. Exemplary conditions include at least one predefined temperature, humidity, gas composition, flux of electromagnetic radiation, particle stream, pressure, and/or the like. The condition(s) may affect occurrence of a chemical reaction, a biological response (e.g., growth), and/or the like. In exemplary embodiments, the treatment device is an incubator that provides a controlled temperature (e.g., above room temperature).

At least one detection device 52*d* of system 50 may include a signal detector to detect a signal from at least one compartment of a sample holder and/or from at least one sample held by a sample holder during execution of the protocol. The signal may be an electrical, chemical, optical, or magnetic signal, among others. In exemplary embodiments, the detection device may be a plate reader, to detect signals from each well of a multi-well plate. The plate reader may, for example, be a high-throughput reader for high-throughput screening (HTS) or a high-content reader for high-content screening (HCS).

Exemplary electrical signals that may be detected include electrophysiological signals measured from whole cells, spheroplasts, or isolated membranes. The signals may be measured with an automated patch-clamp technique. Exemplary signals include current signals measured while voltage is kept constant, or voltage signals measured while current is kept constant.

Exemplary optical signals that may be detected include detection of optical radiation (ultraviolet, visible, and/or infrared radiation) from at least one compartment of a sample holder, particularly from at least one sample and/or reaction mixture disposed therein. Any suitable property of the optical radiation may be measured, such as intensity, polarization, lifetime, or resonance, among others. The optical signals may be detected with a point detector (e.g., where the point detector is provided by a plate reader), an array detector, or the like. In exemplary embodiments, the detection device includes a CCD image detector, a CMOS image detector, or the like. In some embodiments, the detection device may collect images of a sample, such as images of cells and/or colonies composed of cells. Accordingly, the detection device may include a microscope to magnify cells for imaging.

In some embodiments, the detection device may detect an optical signal from at least one label contained by a sample holder. Exemplary labels that may be suitable include photoluminophores (e.g., fluorescent dyes), among others.

At least one transport device 52*e* of system 50 may move a sample holder between devices 52 during execution of the protocol. The transport device may transfer the same sample holder from device to device until the protocol has been completed, or the sample holder may be changed within the protocol (e.g., by transfer device 52*b* as described above). In any event, transport device 52*e* can remove a sample holder from receiving area 66 of one device and place the sample holder in receiving area 66 of another device, according to the order of steps of the protocol. For example, in the exemplary embodiment depicted in FIG. 1, transport device 52*e* transfers a sample holder 62 from storage device 52*a* to transfer device 52*b*, from transfer device 52*b* to incubation device 52*c*, from incubation device 52*c* to detection device 52*d*, and from detection device 52*d* to storage device 52*a*. Exemplary transport devices for system 50 include robotics (e.g., one or more robot arms), conveyors, or the like.

Each device 52 of system 50 may include a digital processor that acts as a dedicated controller for the device. The controller may keep a log of events and errors. A user may consult the log to investigate a status indicated by the status lights of the device.

III. CONTROL SYSTEM

This section describes exemplary control systems for the sample-processing systems of the present disclosure; see FIG. 1.

Control system 56 may have any suitable relationship to devices 52. The control system may be discrete from all of the devices. For example, the control system may be a master controller having a dedicated digital processor, user interface, display, memory, and/or the like. The master controller may manage equipment and data. Alternatively, the control system may be provided, at least in part, by one or more of devices 52. For example, the control system may be created by the one of the devices acting as a master controller or cooperatively by two or more of the devices. In some embodiments, the controller software may be shared among some or all of the devices and may be coordinated by specialized communication.

The control system may keep a log of events and/or errors for each device of the system. Accordingly, a user may consult the log of a specific device and/or the log of the control system when the status light system indicates a problem has occurred.

Each device may be connected to control system 56 or to one another by any suitable type of connection, to permit communication between the device and control system. The connection may be physical (e.g., electrical ("wired") or optical (such as via a fiber-optic cable)) or wireless (e.g., via radiowaves or other electromagnetic radiation). Accordingly, the control system may be local (in the same room) or remote from the devices. In some embodiments, the control system may communicate with the devices (and/or a user) via the Internet or using established communication protocols such as Bluetooth, TCP/IP, or the like. The devices may have different modes of connection to the control system. For example, one or more of the devices may be physically connected and one or more of the devices may be connected wirelessly.

The control system may have any suitable communication with each device. The control system may receive status signals from each of the devices and may send commands to the devices. The commands may, for example, cause a device to initiate a step of the protocol or to emit visible radiation with its status lights to indicate a current device status according the coding scheme of the status light system. In some embodiments, the control system may communicate the coding scheme to each device in order for the device to autonomously control operation of its status lights. In some embodiments, each device may control operation of its status lights when not connected to the control system, and then may give control to the control system as soon as the device is in communication with the control system.

IV. STATUS LIGHTS AND LIGHTING SCHEMES

This section describes exemplary status lights 60 and lighting schemes (also called coding schemes) for a status light system 58 of the present disclosure; see FIG. 1.

Each device 52, and, optionally, control system 56, may have or more status lights 60 to emit visible radiation indicating a current status of the device or control system. The one or more status lights may be provided by any suitable light source or collection of light sources. Exemplary light sources that may be suitable include electroluminescent light sources (e.g., light-emitting diodes, electroluminescent sheets, electroluminescent wires, or the like), incandescent light sources, gas discharge light sources, high-intensity discharge light sources, or the like. The light source could also be a two-dimensional display such as a CRT display unit, LCD flat panel display, OLED display, or plasma display. In some embodiments, the light source may produce a holographic image.

In exemplary embodiments, the status lights are provided by a light-emitting unit composed of a plurality of light sources, such as a plurality of light-emitting diodes (LEDs). The light-emitting unit may be elongated, to form a light-emitting strip. The strip may be arranged to extend along any suitable path, such as a single straight line, an arc, a pair of nonparallel intersecting lines, a U-shape, a polygon, a circle, or the like. Each device may have any suitable number of one or more light-emitting units, each capable of displaying each device status of a set of predefined statuses. In exemplary embodiments, the device has two, three, four, or more light-emitting units that are each positioned near and/or are mostly closely associated with a different side (top, bottom, front, back, left, and/or right) of the device.

The light-emitting unit may be composed of a plurality LEDs (e.g., red (R), green (G), and blue (B) LEDs). The unit may be an LED strip of at least about 5, 10, 20, or 50 cm, among others. The LED strip may have a plurality of sets of clustered LEDs (e.g., with each set having at least one R, G, and B LED). The sets of LEDs may be spaced from one another by any suitable distance, such as about 1-50 mm, among others. Each LED can be set to an intensity value within a range of permitted values (e.g., 1-264). Accordingly, each cluster of LEDs may be capable of displaying a large number of different colors.

In exemplary embodiments, the status lights and/or light-emitting unit is capable of emitting visible radiation of two or more distinguishable colors, with each color corresponding to a different device status. The colors may be resolved from one another temporally (e.g., displayed serially) and/or spatially (e.g., displayed at different positions of a light-emitting unit). Exemplary colors that may be distinguishable include red, orange, yellow, green, blue, white, etc. Exemplary colors that may be distinguishable may be shades of one another, such as light green and dark green, or light blue and dark blue, among others.

The status lights (and/or the light-emitting unit) also or alternatively may emit visible radiation having a fixed or varying intensity. For example, the visible radiation may be continuous, periodic (e.g., flashing according to a square wave function), continuously varying (e.g., oscillating according to a sinusoidal function), or the like. The variability of the visible radiation may or may not help to indicate a device status.

The status lights of a status light system may indicate any suitable number and type of statuses. Exemplary statuses conveyed by the status light system for each device include any combination of (a) off, (b) powered on but not in communication with the control system, (c) in communication with the control system, (d) ready to perform a step of the protocol, (e) busy performing a step of the protocol, (f) warning (still operational but needs user attention), (g) fatal error (not operational), and the like.

An exemplary lighting scheme may convey status for each device with only three colors. A first color, such as green, may indicate that the device is powered on but idle. A second color, such as blue, may indicate that the device is busy performing part of a predefined protocol, such as acquiring images/data. A third color, such as red, may indicate that the device has thrown an error. In some embodiments, different types of errors may be indicated by different colors.

In some embodiments, the status light system may convey device-specific statuses. A particular device of the sample-processing system may have a set of one or more statuses that are specific to that device. The status lights of the particular device may indicate a device-specific status with a unique color, where the status is not pertinent to other devices of the system.

The status lights of each device may display only one status at a time or may display two or more statuses at the same time or in alternation. The status lights for the device may be provided by a light-emitting unit having a plurality of independently controllable pixels (e.g., with each pixel created by a cluster of LEDs (such as RGB LEDs)). The color and temporal behavior of the light-emitting unit can be modulated pixel-by-pixel. Accordingly, the light-emitting unit can display two or more colors at the same time in different regions of the unit.

In some embodiments, the status light system may allow a unique color to be assigned to a particular experiment, sample holder(s), and/or sample(s). The status light system then would allow a user to track the progress of the experiment, sample holder, and/or sample within the sample-processing system as a protocol is being performed.

V. SAMPLE HOLDERS AND SAMPLES

This section describes exemplary sample holders 62 and samples 64 for the sample-processing systems of the present disclosure.

Each sample holder may define a single compartment or multiple compartments for holding samples. Each compartment may have a floor and at least one side wall that surrounds the floor to create a vessel capable of holding fluid. The vessel may have a fluid-holding capacity of any suitable volume, such as about 1 μL to 100 ml, among others. The compartments of a sample holder may be arranged in an array composed of only a single row or multiple rows (e.g., forming two or more columns). For example, the array may be a 2×2, 3×2, 4×4, 6×4, 8×4, 12×8, or 24×16 array, among others, of rows and columns). Each compartment may be a well having an open top, which may be covered by a removable lid of the sample holder. Accordingly, the sample holder may be a single-well container or a multi-well container having 4, 6, 16, 24, 32, 96, or 384 wells, among others. Exemplary sample holders that may be suitable include multi-well plates, petri dishes, flasks, microscope slides (with or without an attached chamber), and the like.

The control system may store information about the current location of the sample holder within the processing system, each event that has occurred for the sample holder, and/or any data collected from the sample holder by at least one detector of the sample-processing system. Each sample holder may have a unique code, such as a barcode, to identify and allow tracking of the sample holder within the sample-processing system.

The sample holder may hold any suitable organic and/or inorganic sample. The sample may or may not be a biological sample containing one or more biomolecules and/or biomolecular assemblies (proteins, nucleic acids, carbohydrates, cells (e.g., bacteria or eukaryotic cells), organelles, etc.). Exemplary biological samples include cell extracts, isolated biomolecules, soil samples, air samples, water samples, blood samples, clinical samples, etc.

VI. EXAMPLES

The following examples describe selected aspects and embodiments of the present disclosure related to sample-processing systems that include a status light system. These examples are included for illustration and are not intended to limit or define the entire scope of the present disclosure.

Example 1. Exemplary Color Scheme and Displayed Color Configurations

Figure 2:
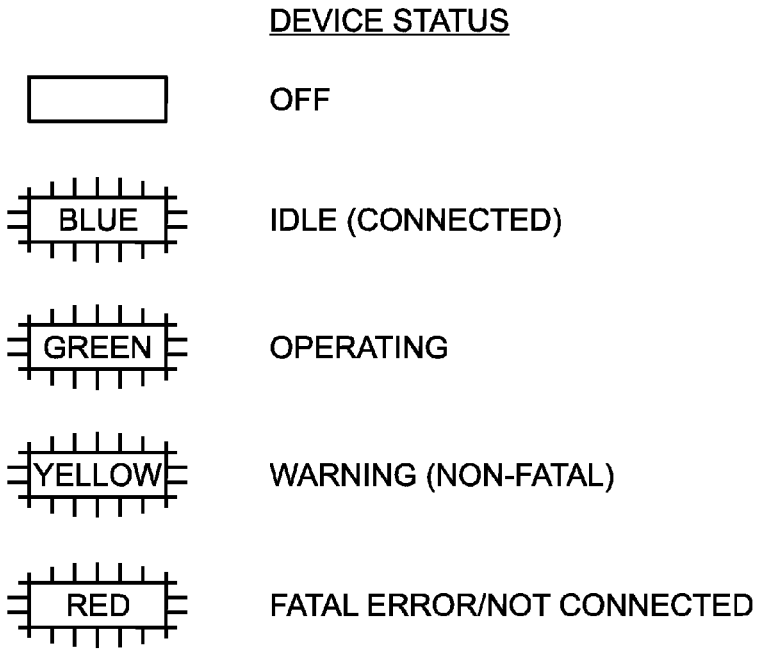
FIG. 2 is a table containing an exemplary color scheme for the status lights of each device in the sample-processing system of FIG. 1.
Figure 3:
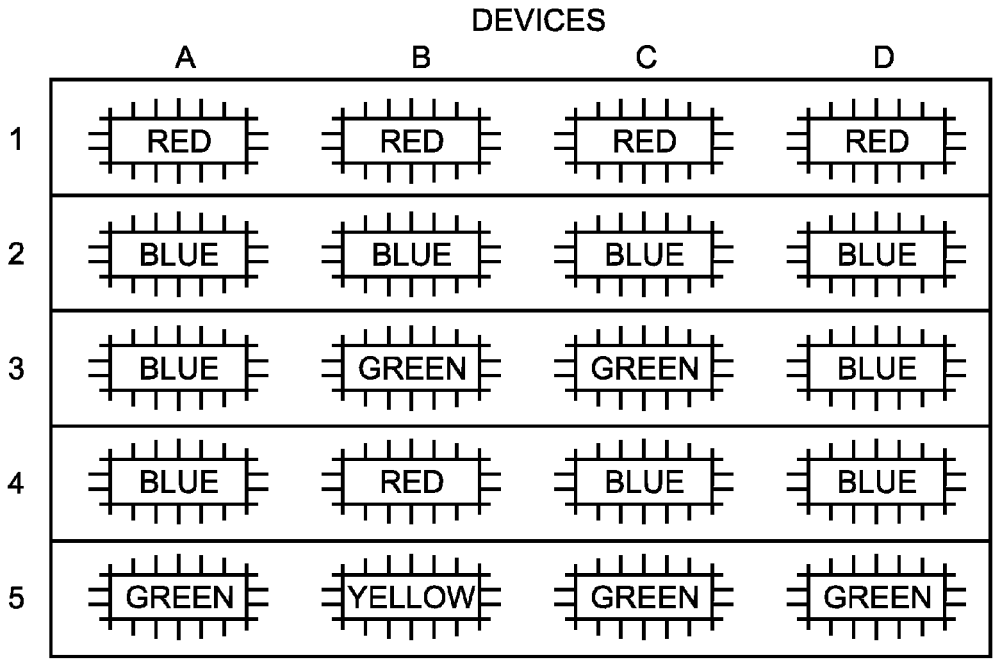
FIG. 3 is a series of exemplary configurations (1-5) that may be generated by the status lights of a sample-processing system composed of four devices (A-D), with each configuration representing a different time point before or during the execution of a protocol by the sample-processing system, in accordance with aspects of the present disclosure.

This example describes an exemplary color scheme for the status lights of a sample-processing system, and illustrates how displayed color configurations allow a user to monitor the system and quickly identify inefficiencies, warnings, fatal errors, and the like; see FIGS. 2 and 3.

FIG. 2 schematically shows (i) a set of colors that may be displayed by a status-light unit of a device and (ii) a device status indicated by each of the colors. The status-light unit may not emit light until the device is powered on. After the device is powered on and communicating with the control system, the status-light unit may display a color, such as blue, to indicate that the device is ready to perform a step of the protocol. While the device is performing the step, the status-light unit may display a different color, such as green, to indicate that the device is busy. Normal operation of the device may include varying shades of green and blue lighting.

The status-light unit may display still another color, such as yellow, if a warning condition (i.e., a non-fatal error) exists for the device that allows sample processing to continue. Exemplary warning conditions include experimental failures. For example, cells/colonies may not be detected or may not be acceptable. As another example, the device may have run out of a fluid, plates, or other ancillary supplies. As yet another example, the device may be performing a step that is taking longer than expected, thereby creating a bottleneck in the sample-processing line. In any event, the device may require user attention, which may or may not bring down the sample-processing line.

The status-light unit may display yet another color, such as red, if the device has suffered a failure (i.e., a fatal error) that brings down the sample-processing line. Exemplary failures may include intrinsic machine failures, such as an electrical, mechanical, software, or optical failure, among others. This type of failure is likely to require field service. Other exemplary failures include operational failures, such as an equipment jam, a dimmed or burned out light, etc. An operational failure may or may not be user-repairable. The status-light unit may display the same color (e.g., red) when the device is not communicating with the control system, either at start-up or if the connection is lost later. The light unit might be blinking on and off (or otherwise varying in intensity temporally), in order to further indicate status.

FIG. 3 shows a series of displayed color configurations (1-5) that may be observed for a set of devices (A-D) of an exemplary sample-processing system having a status light system utilizing the color scheme of FIG. 2. The first color configuration, red for each device, indicates that none of the devices are operational to perform a step of the protocol. The all-red configuration may occur when the devices are first turned on, before each has achieved communication with the control system, or may occur if the control system crashes, is not powered on, or otherwise suffers an error that causes all of the devices to lose their connection. The second configuration, blue for each device, indicates that each device is in communication with the control system and ready to perform part of the protocol. The third configuration, part blue and part green, indicates that devices A and D are idle, while devices B and C are busy performing part of the protocol. A user may monitor the status lights to identify bottlenecks in sample processing and to improve the efficiency of the sample-processing line. The fourth configuration, one red and three blue, indicates that device B (displaying red) has suffered a fatal error, which disrupted the sample-processing line, causing the other three devices (A, C, and D) to become idle (displaying blue). The fifth configuration, one yellow and three green, indicates that device B (displaying yellow) needs attention from the user, but has not disrupted sample processing by the other devices (each displaying green).

Example 2. Exemplary Temporal Modulation of Status Lights

Figure 3A:
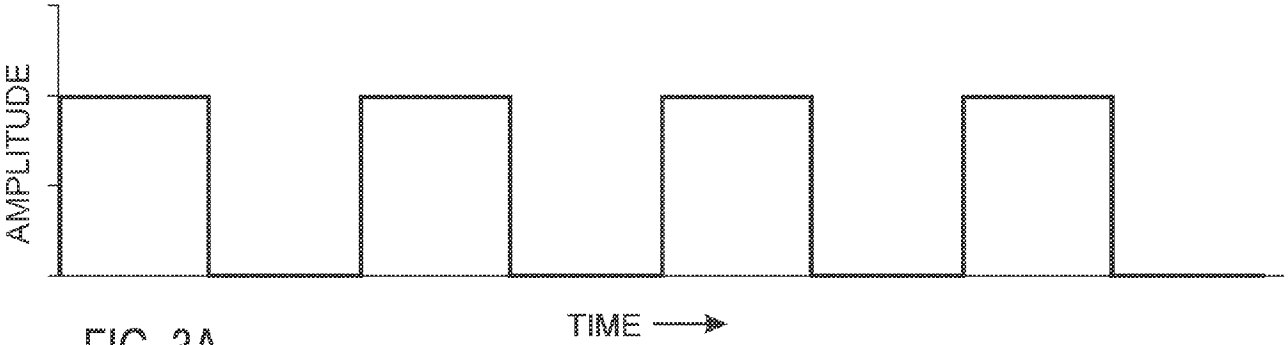
FIG. 3A is a graph of an exemplary blinking pattern for a status light of an exemplary sample-processing system, where the amplitude of emitted light varies over time according to a square wave to provide a temporal component of a visual indicator, in accordance with aspects of the present disclosure.
Figure 3B:
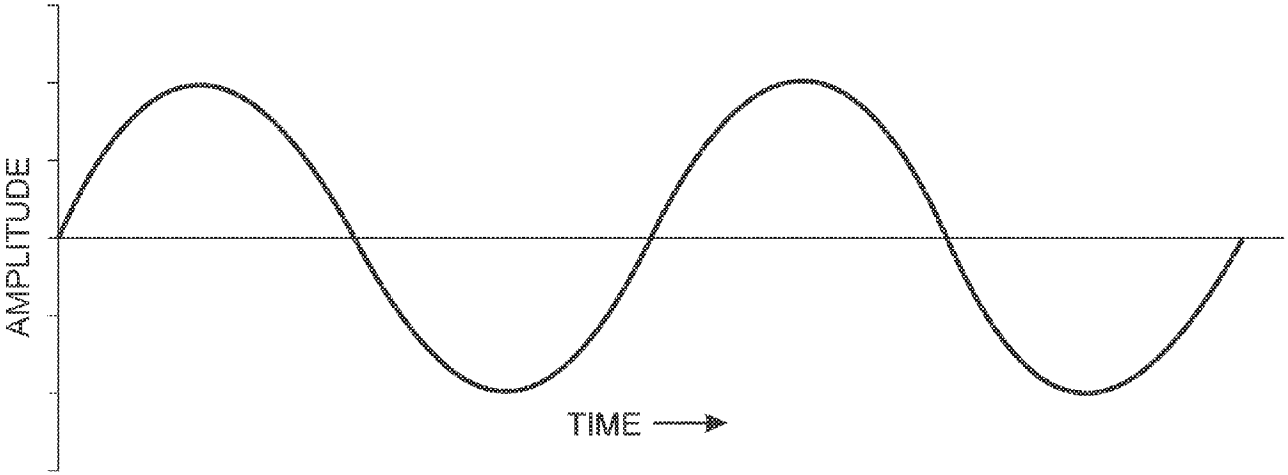
FIG. 3B is a graph of an exemplary oscillating pattern for a status light, where the amplitude of emitted light varies over time according to a sine wave to provide a temporal component of a visual indicator, in accordance with aspects of the present disclosure.
Figure 4:
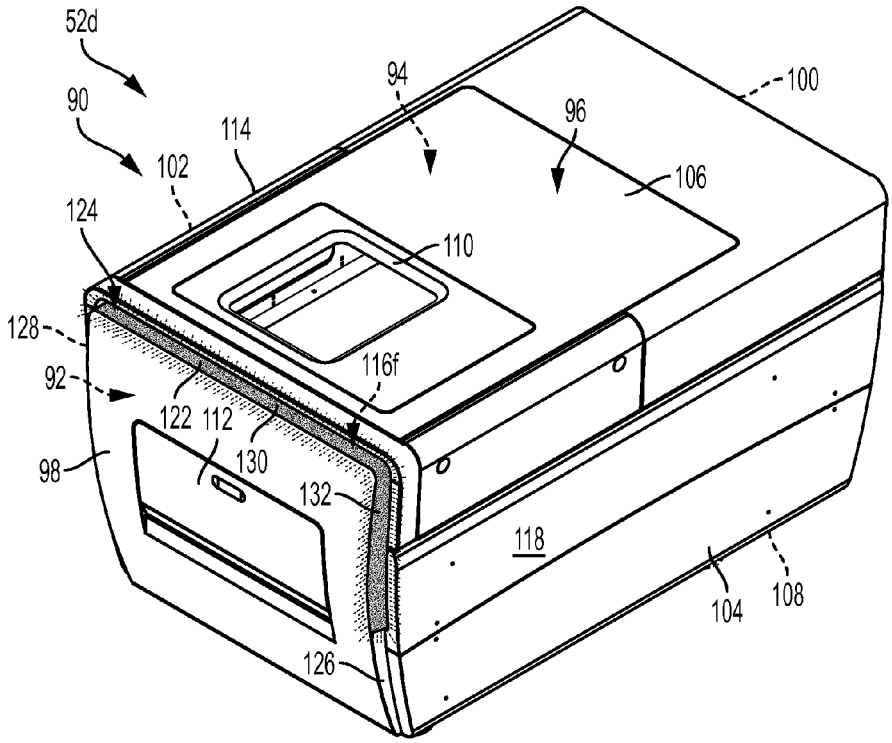
Figure 5:
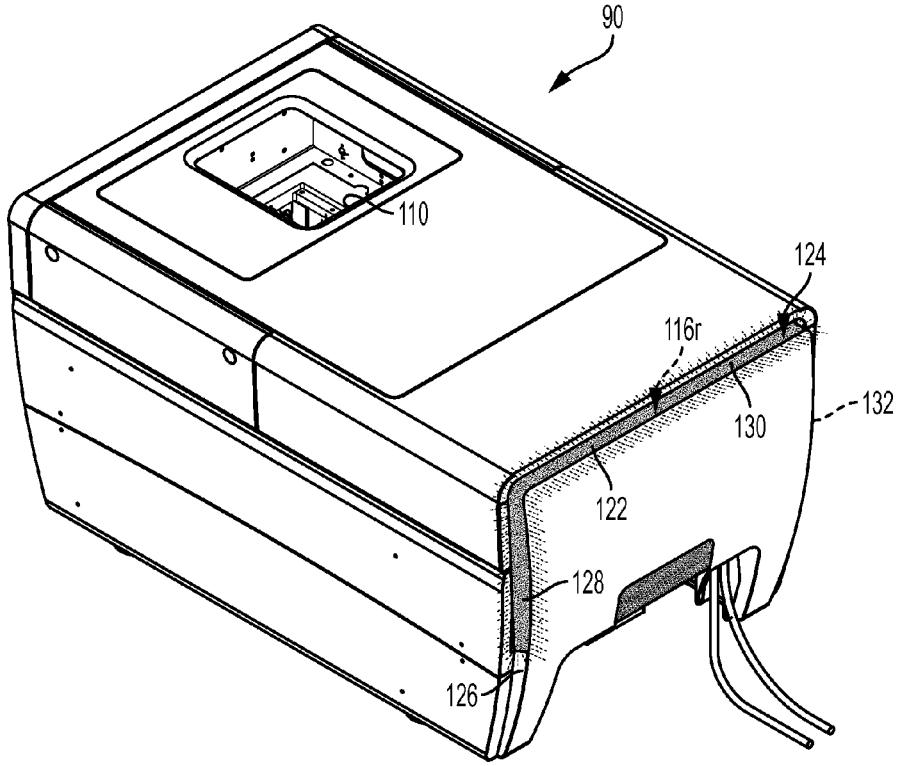
Figure 6:
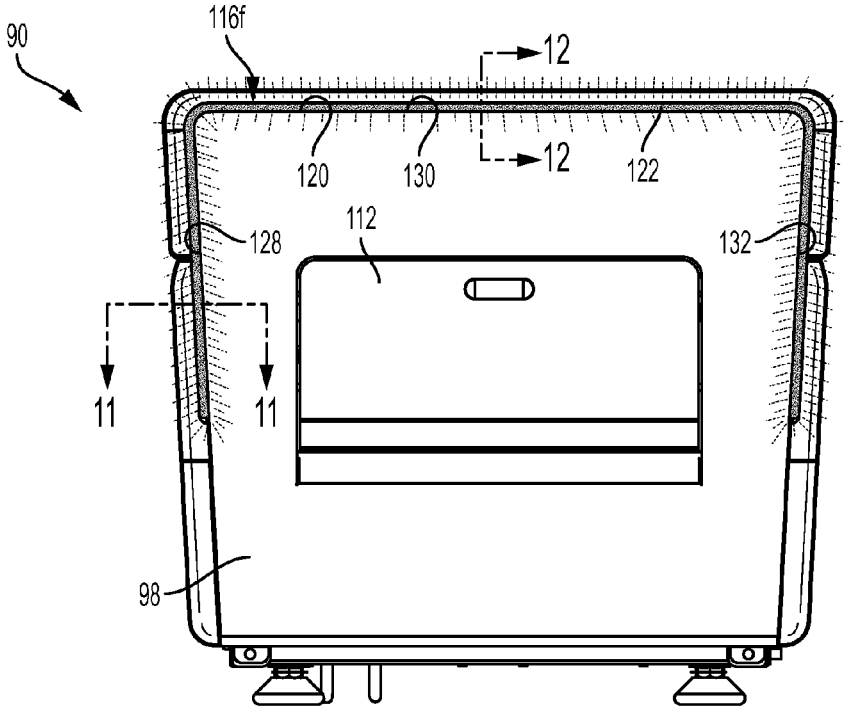
Figure 7:
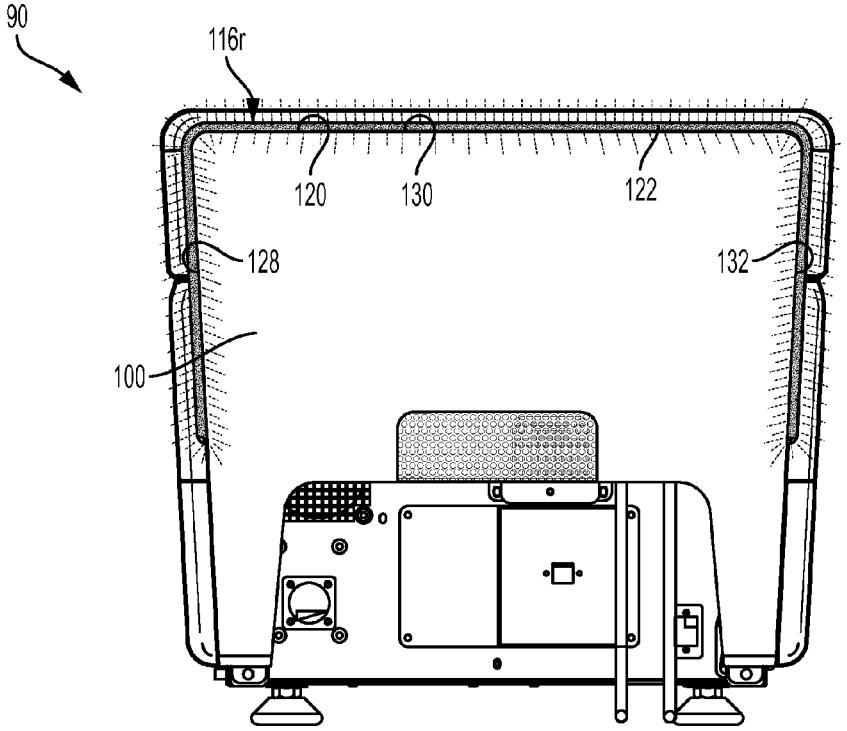
Figure 8:
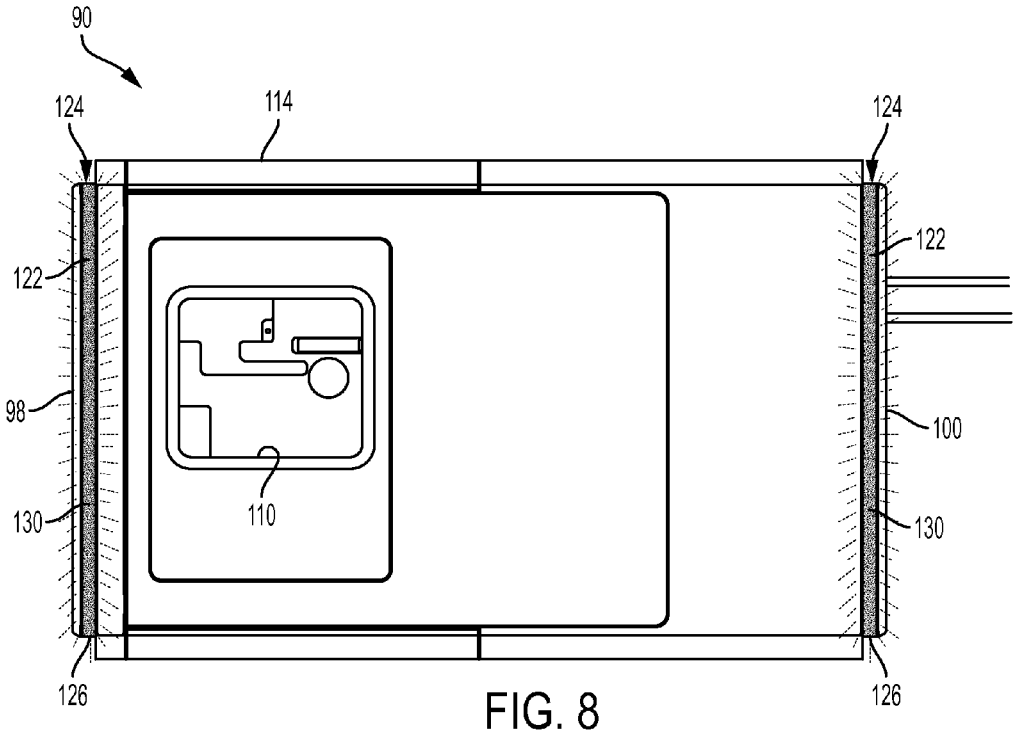
Figure 9:
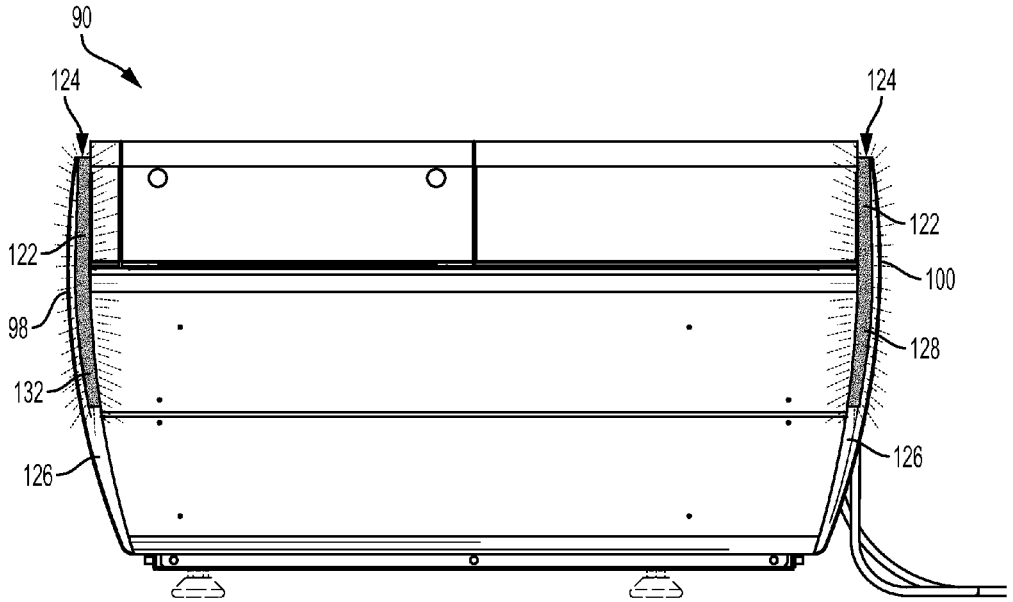

This example describes exemplary temporal modulation of status lights to create a temporal component of a visual indicator that indicates status; see FIGS. 3A and 3B.

FIGS. 3A and 3B show graphs of a temporally varying intensity of light emitted by a status light of an exemplary sample-processing system. The amplitude of emitted light may vary over time, such as stepwise according to a square wave (FIG. 3A) or continuously (e.g., via a sine wave) (FIG. 3B), among others. In other words, the status light may have an on/off pattern or a fade in/out pattern. The maximum and minimum amplitude of light emission may be selected by a user, such as via a graphical user interface, or may be preset during manufacture. The frequency of amplitude modulation also may be under software control, and adjustable by the user, such as via a graphical user interface.

Example 3. Exemplary Detection Instrument

This example describes an exemplary embodiment 90 of a detection instrument 52*d* for sample-processing system 50; see FIGS. 4-12.

FIGS. 4-9 show various views of detection instrument 90. Instrument 90 may include optics 92 to generate images of samples, and an image detector 94 to detect the images. The image detector may, for example, be a charge-coupled device (CCD) or an active pixel sensor (e.g., a CMOS sensor). Optics 92 may form a microscope to generate magnified images of samples, such as biological cells, which may form colonies that are imaged. The optics may include any suitable optical elements, such as one or more lenses, mirrors, prisms, gratings, filters, light guides, light mixers, etc.

Instrument 90 has various access structures, which may be formed by a housing 96 and/or at least one panel on any suitable side of the instrument, namely, a front side 98, a back side 100, a left side 102, a right side 104, a top side 106, and/or a bottom side 108. A sample port 110 (a top door) is formed on top side 106. The top door permits sample holders (e.g., multi-well plates) to be introduced for analysis and then removed. A front door 112 is formed on front side 98 and provides access to at least one emission filter of optics 92, which allows the filter to be removed and/or swapped by the user. A side door 114 is formed on left side 102 and provides access for the user to at least one objective (e.g., one or more objective lenses) of optics 92. Microscope objectives may be swapped via side door 114. Power input and data input/output are located on back side 100. The data input/output may be connected to a communication unit of the instrument that provides communication with an outside controller (e.g., see Section I).

Instrument 90 has status lights 60 provided by a pair of LED units 116*f*, 116*b*, which are mounted to housing 96 at front side 98 and back side 100, respectively. Each LED unit may be recessed with respect to an exterior 118 of instrument 90. Accordingly, to allow visible radiation from the LED unit to travel out of the instrument, housing 96 may define an opening 120 associated with each LED unit. Opening 120 provides communication between the LED unit and exterior 118. In the depicted embodiment, each LED unit and corresponding opening 120 are U-shaped and aligned with one another. Each LED unit itself, and visible radiation 122 therefrom, are visible directly along a line of sight orthogonal to front side 98 (unit 116*f*) or back side 100 (unit 116*b*) (see FIGS. 6 and 7). However, only visible radiation 122 (also called visible light or light) emitted by the LED unit, and not the LED unit itself, is visible along a respective line of sight that is orthogonal to left side 102, right side 104 (see FIG. 9), or top side 106 (see FIG. 8). Stated more generally, visible radiation 122 emitted by the LED units is visible at a distance from positions above the instrument, in front of the instrument, behind the instrument, to the left of the instrument, and to the right of the instrument (i.e., from positions outward of at least five sides of the instrument). Light emitted by the LED units (i.e., the visual indicators displayed by the LED units) may be visible from substantially any position on a circle (of suitable size) surrounding the instrument. The circle may be horizontal and may define a plane that intersects the instrument and/or a central point of the instrument, among others. In some embodiments, the visual indicators displayed by the LED units may be visible from substantially any position on a hemisphere having a center of curvature at a central point of the instrument, and forming a great circle at a bottom of the hemisphere that is coplanar with the central point. The radius of the hemisphere may, for example, be about 2, 3, or 4 times the length of the instrument.

The ability to see light 122 emitted by each recessed LED unit may be created by a pair of respective protrusions 124 defined by opposite sides of the instrument, such as front side 98 and back side 100 of instrument 90 in the depicted embodiment (see FIGS. 4, 5, 8, and 9). Each protrusion creates a protruding wall region 126 that can reflect light from the LED unit toward a user's eye. The protruding wall region may project outward from opening 120 and may be shaped according to the associated opening and/or LED unit. For example, in the depicted embodiment wall region 126 is U-shaped. The wall region may have areas 128, 130, and 132 that face in different directions from one another. In the depicted embodiment, areas 128 and 132 face away from one another and each is oriented transversely (e.g., orthogonally) to area 130. Furthermore, each area 128, 130, and 132 is oriented transversely (e.g., orthogonally) to a plane defined by associated front side 98 or back side 100.

Figure 10:
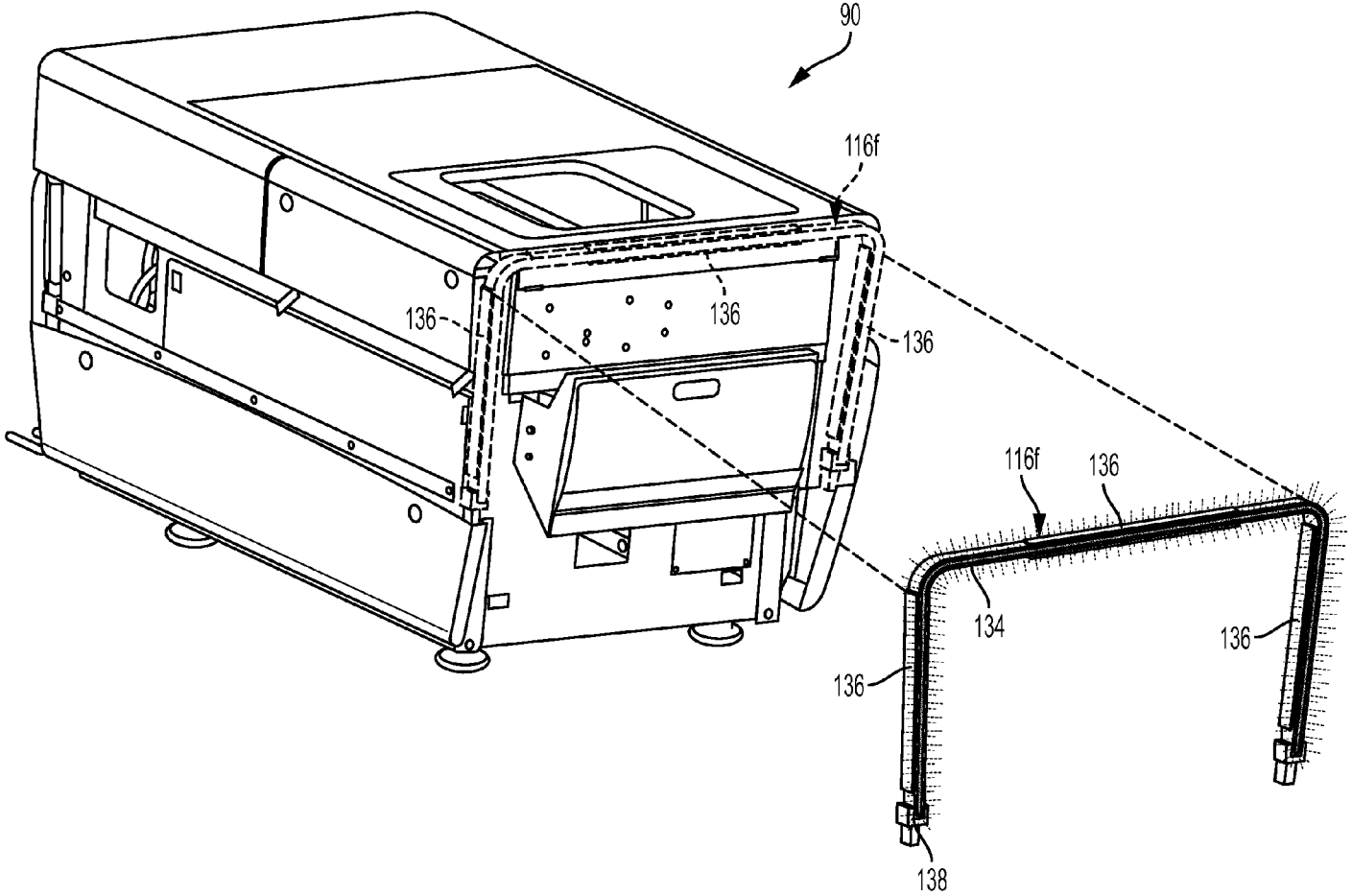
FIG. 10 is an exploded view of selected aspects of the detection instrument of FIG. 4, particularly a front LED strip mounted near the front side of the instrument.

FIG. 10 shows instrument 90 with front panels and a left side panel removed. LED unit 116*f* includes an LED strip 134 mounted to housing 96 with channel members 136 each arranged vertically or horizontally to create a U-shaped path along which the LED strip extends. The LED unit may be powered by an electrical connection formed at an end 138 thereof. LED unit 116*r* may be mounted similarly at back side 100 of instrument 90.

Figure 11:
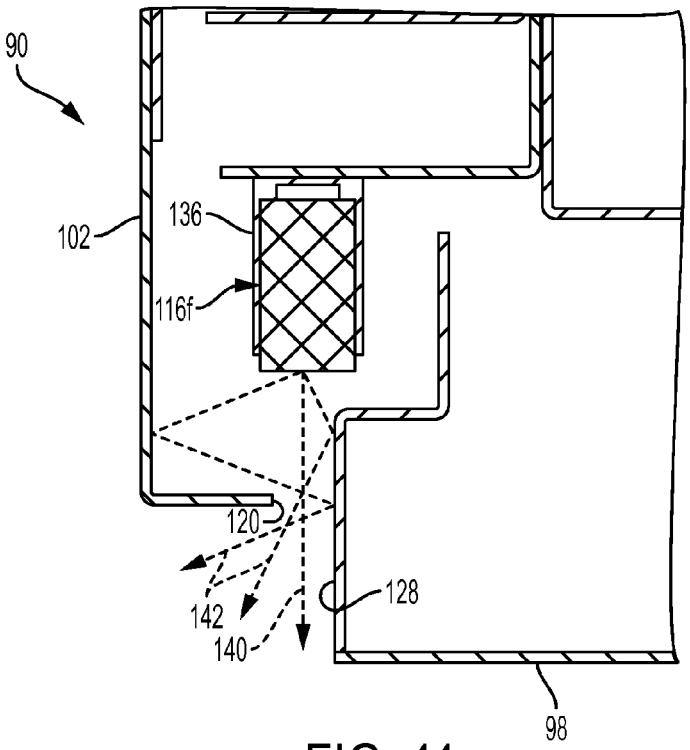
FIG. 11 is a fragmentary sectional view of the detection instrument of FIG. 4, taken generally along line 11-11 of FIG. 6 through the front LED strip and illustrating exemplary light rays for light emitted by the LED strip.
Figure 12:
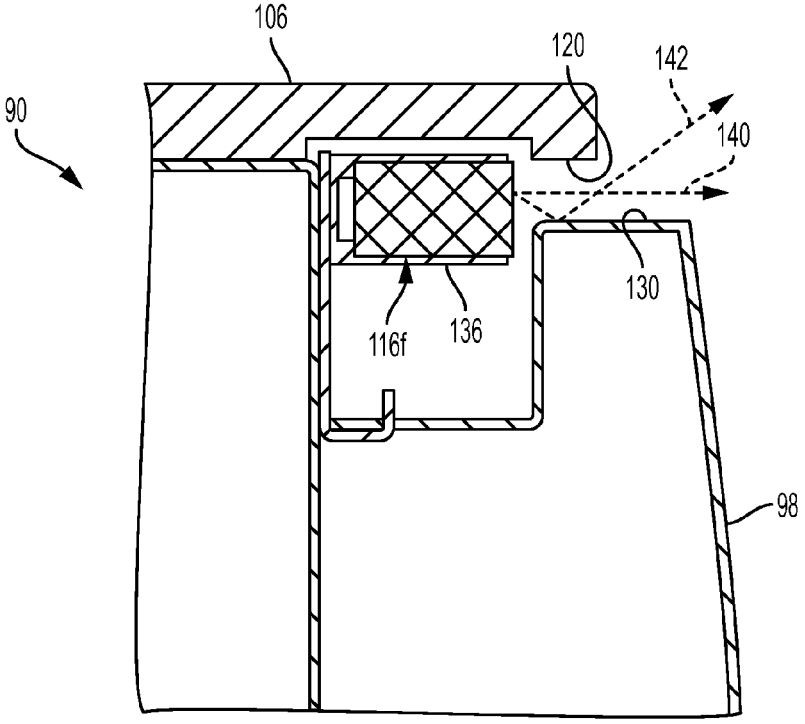
FIG. 12 is another fragmentary sectional view of the detection instrument of FIG. 4, taken generally along line 12-12 of FIG. 6 through the front LED strip and illustrating exemplary light rays for light emitted by the LED strip.

FIGS. 11 and 12 illustrate exemplary light rays 140, 142 for light emitted by LED unit 116*f*. Light ray 140 travels from the LED unit, directly through opening 120, and out of instrument 90, without being reflected by housing 96. Accordingly, if the user's eye is positioned to receive light ray 140, a region of the LED unit is directly visible by the user. Light rays 142 are reflected off walls of housing 96 and may allow light emitted by the LED unit to be visible over a range of at least about 90 degrees in a horizontal plane (FIG. 11) or a vertical plane (FIG. 12).

Example 4. Exemplary User Interface

Figure 13:
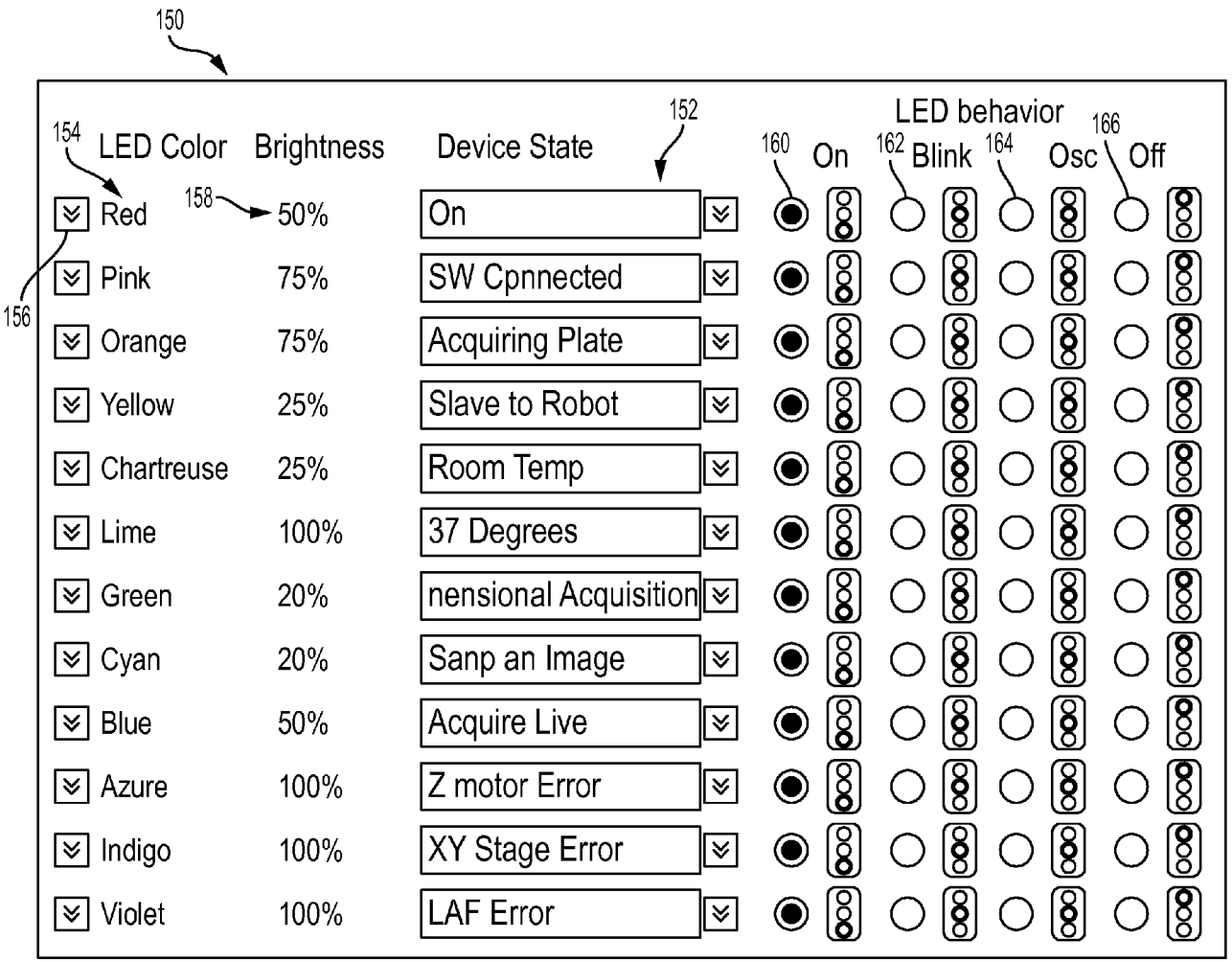
FIG. 13 is an exemplary screenshot taken from a graphical user interface of the sample-processing system of FIG. 1 and illustrating exemplary user-selectable statuses, color assignments, and temporal behavior for the status lights of the system.

This example describes selected aspects of an exemplary user interface 150 for a sample-processing system with status lights; see FIG. 13.

A list of exemplary device states 152 are presented to the user. Some or all of the states listed may be pertinent to every device of a sample-processing system. (For example, "On," "SW Connected," while one or more of the states may be relevant only to device 90 (see Example 2). For each state, the user can select an LED color 154 that will correspond to the state. The color may be selected from a list of colors provided by a drop down menu 156. A brightness for the color can be selected at 158. The brightness can be typed (e.g., as a number between 1 and 100) or may be selectable from a menu. LED behavior for the selected color also can be set. Display of the selected color by the LED may be turned on or off, such as with radio buttons 160, 162, 164, and 166, based on whether or not the user wants the corresponding state to be indicated by the status lights. In the depicted embodiment, the user has a choice for continuous ("On") (button 160), blinking (button 162), or sinusoidally oscillating (button 164) behavior when the color is displayed.

Example 5. Selected Embodiments

This example describes selected embodiments of the present disclosure as a series of indexed paragraphs.

[1] A system for sample-processing, comprising: (A) a plurality of devices to perform a protocol on sample holders supporting samples, each device performing at least one step of the protocol, at least one of the devices including a transport mechanism to move sample holders between other devices of the plurality of devices; and (B) a control system that coordinates operation of the plurality of devices, such that the protocol is performed automatically, wherein each device of at least two of the plurality of devices has one or more status lights configured to display a plurality of different visual indicators each indicating a different status of the device, wherein the at least two devices utilize a same indicator scheme as one another for each different status indicated by the visual indicators.

[2] The system of paragraph 1, wherein two or more of the plurality of visual indicators are different in color from one another.

[3] The system of paragraph 1 or 2, wherein at least one visual indicator of the plurality of visual indicators has a different temporal modulation than another visual indicator of the plurality of visual indicators.

[4] The system of any of paragraphs 1 to 3, wherein each visual indicator displayed by a device is visible from substantially any position on a horizontal circle surrounding the device.

[5] The system of any of paragraphs 1 to 4, wherein the one or more status lights of each device of the at least two devices display a different visual indicator for each of at least the following statuses: (i) the device is turned on but not in communication with the control system, (ii) the device is turned on and in communication with the control system but not currently performing part of the protocol, and (iii) the device is currently performing part of the protocol.

[6] The system of paragraph 5, wherein the one or more status lights of each device of the at least two devices display another different visual indicator if an error occurs for the device.

[7] The system of paragraph 6, wherein the error prevents the device from performing a step of the protocol, and wherein the one or more status lights of each device of the at least two devices display still another different visual indicator if a warning condition occurs for the device.

[8] The system of any of paragraphs 1 to 7, wherein the one or more status lights of one or more devices of the at least two devices are provided by a light-emitting strip.

[9] The system of paragraph 8, wherein the light-emitting strip includes a plurality of light-emitting diodes arranged along the light-emitting strip.

[10] The system of paragraph 8 or 9, wherein the light-emitting strip is recessed with respect to an exterior of the one or more devices.

[11] The system of paragraph 10, wherein the one or more devices define an opening through which visible radiation emitted by the light-emitting strip leaves the one or more devices, and wherein the or more devices have a U-shaped, protruding external wall region associated with the opening such that the external wall region is illuminated by the visible radiation.

[12] The system of paragraph 11, wherein illuminated areas of the external wall region face in opposite directions from one another.

[13] The system of any of paragraphs 1 to 12, further comprising a graphical user interface connected to the control system and configured to permit a user to select a color to be displayed by the one or more status lights of each device of the at least two devices for a given status of the device.

[14] The system of any of paragraphs 1 to 13, wherein each device of the at least two devices is configured to receive sample holders selected from the group consisting of multi-well plates, petri dishes, flasks, and microscope slides.

[15] The system of any of paragraphs 1 to 14, wherein at least one device of the at least two devices includes a signal detector to detect a signal from each sample.

[16] The system of paragraph 15, wherein the signal detector is configured to detect images of biological cells.

[17] The system of paragraph 15, wherein at least one device of the at least two devices includes a plate reader configured to detect a signal from each well of a multi-well plate.

[18] The system of any of paragraphs 1 to 17, wherein at least one device of the at least two devices includes a colony picker.

[19] The system of any of paragraphs 1 to 18, wherein at least one device of the at least two devices is configured to collect electrophysiology data.

[20] The system of any of paragraphs 1 to 19, wherein the control system is provided by one or more of the plurality of devices and/or the at least two devices.

[21] The system of any of paragraphs 1 to 19, wherein the control system is provided by a master controller that is separate from each of the plurality of devices.

[22] The system of any of paragraphs 1 to 21, wherein at least one of the plurality of devices and/or the at least two devices has a physical connection to the control system.

[23] A method of sample-processing with a plurality of devices including at least one device including a transport mechanism to move sample holders between other devices, the plurality of devices being in communication with a control system, the method comprising: (A) receiving, at the control system, a protocol for sample-processing; (B) performing the protocol automatically with the plurality of devices and with device operation coordinated by the control system, wherein each device performs at least one step of the protocol; and (C) displaying one or more visual indicators with one or more status lights of each device of at least two of the plurality of devices according to a current status of the device before, during, and after the step of performing the protocol automatically; wherein the one or more status lights of each device of the at least two devices are configured to display a plurality of different visual indicators each indicating a different status, and wherein the at least two devices utilize a same indicator scheme as one another for each of the different statuses indicated by the different visual indicators.

[24] The method of paragraph 23, further comprising a step of receiving, at the control system, a preference from a user that assigns a particular color to a given status, and a step of communicating the preference with the control system to each device of the at least two devices such that the one or more status lights of the device display the particular color if the given status occurs for the device.

[25] The method of paragraph 24, wherein the control system is connected to a graphical user interface that allows a user to select the particular color from a plurality of color options for the given status.

[26] The method of any of paragraphs 23 to 25, wherein a different visual indicator is displayed by the one or more status lights of each device of the at least two devices for each of the following statuses: (i) the device is on but not in communication with the control system, (ii) the device is on and in communication with the control system but not currently performing a step of the protocol, (iii) the device is performing a step of the protocol, and (iv) an error has occurred for the device.

[27] The method of any of paragraphs 23 to 26, wherein at least a portion of the protocol is performed with samples disposed in an array of wells.

[28] The method of paragraph 27, wherein the step of performing the protocol includes a step of detecting a signal from a sample in each well.

[29] The method of any of paragraphs 23 to 28, wherein at least a portion of the protocol is performed with samples including biological cells.

[30] The method of paragraph 29, wherein at least a portion of the protocol is performed with the biological cells being alive and in contact with a growth medium.

[31] The method of any of paragraphs 23 to 30, wherein the protocol includes picking colonies composed of biological cells.

[32] The method of any of paragraphs 23 to 31, wherein at least a portion of the protocol is performed with samples disposed in an array of wells.

[33] The method of any of paragraphs 23 to 32, wherein at least a portion of each sample is moved to a different sample holder during the step of performing the protocol.

[34] The method of any of paragraphs 23 to 33, wherein the at least two devices include at least one device selected from the group consisting of a plate reader, a microscope-based image detector, a colony picker, and an automated electrophysiology device.

[35] The method of any of paragraphs 23 to 34, wherein the protocol includes detecting a signal from each sample.

[36] A device for sample-processing, comprising: (A) a receiving area for a sample holder; (B) a signal detector to detect a signal from a sample supported by the sample holder; (C) a communication unit allowing for communication with an outside controller; and (D) a light-emitting strip configured to display a plurality of different colors each indicating a different status of the device; wherein the light-emitting strip is mounted in a recessed position with respect to an exterior of the device.

[37] The device of paragraph 36, wherein the device includes a housing defining an elongated opening through which visible radiation from the light-emitting strip travels out of the device.

[38] The device of paragraph 37, wherein the device has a protruding external wall region adjacent the opening, and wherein the light-emitting strip is configured to illuminate the external wall region.

[39] The device of paragraph 38, wherein the light-emitting strip is configured to illuminate areas of the external wall region that face away from one another.

[40] The device of paragraph 39, wherein the light-emitting strip is configured to illuminate an area of the external wall region that is transverse to the areas that face away from one another.

[41] The device of any of paragraphs 36 to 40, wherein the device has at least a pair of light-emitting strips each configured to display the plurality of different colors that each indicate a different status of the device.

[42] The device of paragraph 41, wherein the device has a pair of exterior sides facing away from one another, and wherein each light-emitting strip is mounted near a different one of the exterior sides.

[43] The device of paragraph 42, wherein the exterior sides are a front side and a back side of the device, wherein visible radiation emitted by one of the light-emitting strips is visible from a position in front of the device, and wherein visible radiation emitted by the other light-emitting strip is visible from a position behind the device.

[44] The device of paragraph 42 or 43, wherein the light-emitting strips illuminate a pair of spaced, U-shaped external wall regions of the device.

[45] The device of any of paragraphs 36 to 44, wherein the light-emitting strip includes a plurality of light-emitting diodes arranged along the strip.

[46] The device of any of paragraphs 36 to 45, wherein the signal detector is configured to detect images of biological cells.

[47] The device of paragraph 46, wherein the receiving area is configured to receive a petri dish, and wherein the optical detector is configured to detect images of colonies disposed in the petri dish.

[48] The device of any of paragraphs 36 to 47, wherein the sample holder is selected from the group consisting of a multi-well plate, a petri dish, a flask, and a microscope slide.

[49] The device of any of paragraphs 36 to 48, wherein the device is configured to emit light that is visible from substantially any position on a hemisphere, and wherein the hemisphere has a center of curvature at a central point of the device and forms a great circle at a bottom of the hemisphere that is coplanar with the central point.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure. Further, ordinal indicators, such as first, second, or third, for identified elements are used to distinguish between the elements, and do not indicate a particular position or order of such elements, unless otherwise specifically stated.

We claim:

1. A system for sample-processing, comprising:

a plurality of devices to perform a protocol on sample holders supporting samples, each device performing at least one step of the protocol, at least one of the devices including a transport mechanism to move sample holders between other devices of the plurality of devices; and a control system that coordinates operation of the plurality of devices, such that the protocol is performed automatically;

wherein each device of at least two of the plurality of devices has one or more status lights configured to display a plurality of different visual indicators each indicating a different status of the device, wherein the at least two devices utilize a same indicator scheme as one another for each different status indicated by the visual indicators.

2. The system of claim 1, wherein two or more of the plurality of visual indicators are different in color from one another.

3. The system of claim 2, wherein at least one visual indicator of the plurality of visual indicators has a different temporal modulation than another visual indicator of the plurality of visual indicators.

4. The system of claim 1, wherein each visual indicator displayed by a device is visible from substantially any position on a horizontal circle surrounding the device.

5. The system of claim 1, wherein the one or more status lights of each device of the at least two devices display a different visual indicator for each of at least the following statuses:

(a) the device is turned on but not in communication with the control system, (b) the device is turned on and in communication with the control system but not currently performing part of the protocol, and (c) the device is currently performing part of the protocol.

6. The system of claim 5, wherein the one or more status lights of each device of the at least two devices display another different visual indicator if an error occurs for the device.

7. The system of claim 6, wherein the error prevents the device from performing a step of the protocol, and wherein the one or more status lights of each device of the at least two devices display still another different visual indicator if a warning condition occurs for the device.

8. The system of claim 1, wherein the one or more status lights of one or more devices of the at least two devices are provided by a light-emitting strip having a plurality of light-emitting diodes arranged along the light-emitting strip.

9. The system of claim 1, further comprising a graphical user interface connected to the control system and configured to permit a user to select a color to be displayed by the one or more status lights of each device of the at least two devices for a given status of the device.

10. The system of claim 1, wherein at least one device of the at least two devices includes a signal detector to detect a signal from each sample.

11. The system of claim 1, wherein the control system is provided by one or more of the plurality of devices.

12. The system of claim 1, wherein the control system is provided by a master controller that is separate from each of the plurality of devices.

13. The system of claim 1, wherein the plurality of devices includes a storage device configured to hold a plurality of sample holders, and wherein the transport mechanism is configured to individually move each sample holder of the plurality of sample holders from the storage device to another device of the plurality of devices.

14. A method of sample-processing with a plurality of devices including at least one device including a transport mechanism to move sample holders between other devices, the plurality of devices being in communication with a control system, the method comprising:

receiving, at the control system, a protocol for sample-processing;

performing the protocol automatically with the plurality of devices and with device operation coordinated by the control system, wherein each device of at least two of the plurality of devices performs at least one step of the protocol on an array of samples supported by a sample holder that has been moved to the device from another device of the plurality of devices by the transport mechanism; and displaying one or more visual indicators with one or more status lights of each device of the at least two devices according to a current status of the device before, during, and after the step of performing the protocol automatically;

wherein the one or more status lights of each device of the at least two devices are configured to display a plurality of different visual indicators each indicating a different status, and wherein the at least two devices utilize a same indicator scheme as one another for each of the different statuses indicated by the different visual indicators.

15. The method of claim 14, wherein the control system is connected to a graphical user interface that allows a user to select the particular color from a plurality of color options for the given status.

16. The method of claim 14, wherein at least a portion of the protocol is performed with samples disposed in an array of wells.

17. A device for sample-processing, comprising:

a receiving area for a sample holder;

a signal detector to detect a signal from a sample supported by the sample holder;

a communication unit allowing for communication with an outside controller; and a first light-emitting strip and a second light-emitting strip, each light-emitting strip including a plurality of light-emitting diodes arranged along the light-emitting strip, and each light-emitting strip being configured to display a plurality of different colors each indicating a different status of the device;

wherein each light-emitting strip is mounted in a recessed position with respect to an exterior of the device, wherein the device has a pair of exterior sides facing away from one another, and wherein each light-emitting strip is mounted near a different one of the exterior sides, wherein the device includes a housing defining openings through which visible radiation from the first and second light-emitting strips travels out of the device, each opening being elongated parallel to a corresponding one of the light-emitting strips, wherein the housing has a respective protruding external wall region adjacent each opening, and wherein the respective protruding external wall region is configured to reflect visible radiation from the corresponding light-emitting strip to a user.

18. The device of claim 17, wherein the device is configured to emit light that is visible from substantially any position on a hemisphere, and wherein the hemisphere has a center of curvature at a central point of the device and forms a horizontal great circle at a bottom of the hemisphere that is coplanar with the central point.

19. The device of claim 17, wherein the receiving area is configured to receive a petri dish, and wherein the optical detector is configured to detect images of colonies disposed in the petri dish.

20. The device of claim 17, wherein each light-emitting strip is U-shaped and configured to illuminate areas of the corresponding external wall region that face away from one another, and wherein the light-emitting strip also is configured to illuminate an area of the corresponding external wall region that is transverse to the areas that face away from one another.

* * * * *